United States Patent [19]

Yokota et al.

[11] 4,304,454

[45] Dec. 8, 1981

[54] INSULATION PIERCING CONNECTOR

[75] Inventors: Minoru Yokota; Kazuo Sawada, both of Osaka; Junichi Kojima, Suzuka, all of Japan

[73] Assignees: Sumitomo Electric Industries, Ltd., Osaka; Tokai Electric Wire Company, Ltd., Yokkaichi, both of Japan

[21] Appl. No.: 192,836

[22] Filed: Oct. 1, 1980

[30] Foreign Application Priority Data

Oct. 5, 1979 [JP] Japan ..... 54-139354[U]

[51] Int. Cl.[3] ..... H01R 11/12

[52] U.S. Cl. ..... 339/97 C

[58] Field of Search ..... 339/97 C, 97 R, 276 R, 339/276 C, 97 P, 98, 223 R, 276 T; 174/84 C

[56] References Cited

U.S. PATENT DOCUMENTS

| | | | |
|---|---|---|---|
| 2,680,235 | 6/1954 | Pierce | 339/276 T |
| 3,355,698 | 11/1967 | Keller | 339/97 C |
| 3,696,322 | 10/1972 | Spangler | 339/97 C |

*Primary Examiner*—Joseph H. McGlynn
*Assistant Examiner*—John S. Brown
*Attorney, Agent, or Firm*—Wenderoth, Lind & Ponack

[57] ABSTRACT

Improved insulation piercing wire connectors are proposed which are provided with a plurality of prongs on the edges of a wire barrel, said prongs having their top tapering up toward the front for better mechanical and electrical connection.

11 Claims, 9 Drawing Figures

INSULATION PIERCING CONNECTOR

BACKGROUND OF THE INVENTION

The present invention relates to insulation piercing connectors for connecting wires, particularly for aluminum wires.

Connectors for wires or conductors must provide good electrical and mechanical connection. With insulation piercing type connectors, crimping with a conductor placed in the connector decreases the contact resistance of the conductor and ensures good electrical connection by breaking the insulation on the surface of the conductor, but crimping with excessive force impairs the strength of mechanical connection. This is true particularly for aluminum wires that are easily deformed.

Conventional open-barrel type connectors having the flat edges of the wire barrel adapted to be butted together has a shortcoming that after butted together, the edges of the wire barrel tend to get apart from each other owing to the springiness of the material, thus impairing connection characteristics.

SUMMARY OF THE INVENTION

An object of the present invention is to provide an insulation piercing connector which obviates such a shortcoming and which can break the insulation of a conductor more effectively and prevent the loosening of mechanical connection, thereby maintaining good electrical and mechanical connection characteristics over a prolonged period of time.

Another object of the present invention is to provide an insulation piercing connector which encloses a conductor fully when crimped on a conductor.

A further object of the present invention is to provide an insulation piercing connector which less damages the conductor than the conventional connectors.

Other features and advantages of the present invention will become apparent from the following description taken with reference to the accompanying drawings.

DETAILED DESCRIPTION OF THE EMBODIMENTS

Figure 1:
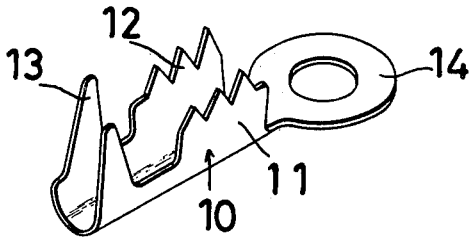
FIG. 1 is a schematic view of the first embodiment of this invention.

Referring to FIG. 1 showing the first embodiment of the present invention, an insulation piercing connector comprises a trough-shaped wire barrel 10 having an opposed pair of side walls 11, each of which is provided with a plurality of prongs 12 at its top edge. The prongs are so shaped and arranged as to pierce into a conductor through its insulation when the connector is crimped around the conductor to be connected.

The connector should be made of a material having a good mechanical strength and a good corrosion resistance, such as brass. The connector further comprises a U-shaped insulation barrel 13 for holding the conductor A (FIG. 3) over the insulation and an electrical connection portion 14.

In the first embodiment shown in FIG. 1, the prongs 12 have their top higher at the end of the wire barrel 10 adjacent to the electrical connection portion 14 than at its opposite end because the prongs are of different sizes. In other words, their top tapers down toward the insulation barrel 13.

Also, the prongs 12 on one side wall 11 should be slightly displaced with respect to the prongs on the other side wall so that they will engage or bite each other when the connector is crimped.

Figure 2:
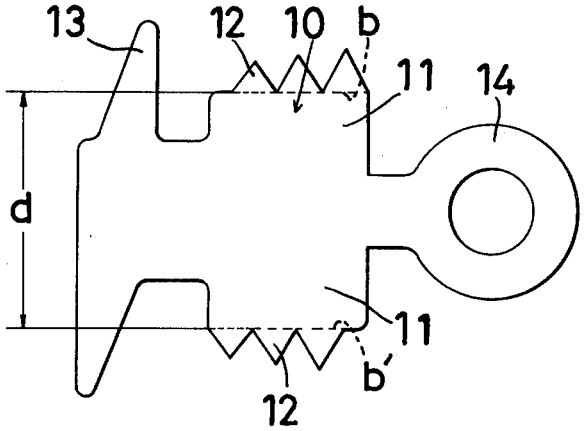
FIG. 2 is a developed view of the same.

Referring to FIG. 2, the creeping distance d between the baseline b of the prongs 12 on one side wall 11 and the baseline b′ of the prongs on the other side wall should be sufficiently long to fully enclose the outer periphery of the conductor. If the distance were insufficient, part of the conductor would be exposed, eventually corroding.

Figure 3:
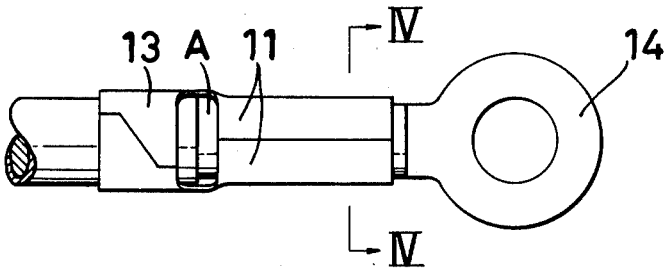
FIG. 3 is a view showing the connector of FIG. 1 crimped on a conductor.
Figure 4:
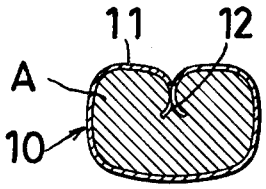
FIG. 4 is a vertical sectional view taken along the line IV—IV of FIG. 3.

When a conductor A is put in the connector and the connector is crimped on the conductor by means of a crimper, the prongs 12 on both of the side walls will bite each other, penetrating into the conductor through its insulation as shown in FIG. 4. With the connector crimped on the conductor A, the latter is fully enclosed by the wire barrel 10 as shown in FIG. 3.

Since the prongs pierce into the conductor through its insulation in a wedge-like manner, good electrical and mechanical connection is assured. Owing to the fact that the prongs 12 penetrate into the conductor deeper at the front portion of the conductor than at its rear portion, the insulation of the conductor is fully broken at the front portion, ensuring good electrical connection, whereas at its rear portion mechanical strength of connection is not so much impaired because the prongs do not penetrate so deep into the conductor. If the prongs bit deep thereinto over the whole length of the wire barrel, the conductor would get damaged too much to maintain satisfactory mechanical strength of connection.

Figure 5:
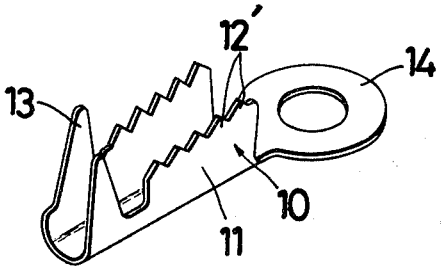
FIG. 5 is a schematic view of the second embodiment.

FIG. 5 shows the second embodiment in which the wire barrel 10 itself has a varying height increasing toward the electrical connection portion 14 with the prongs 12′ of the same size, instead of using the prongs of different size as in the first embodiment. In the second embodiment, too, the prongs have their top tapering down toward the rear of the connector, that is, toward the insulation barrel 13. The second embodiment is the same function as the first embodiment.

Figure 6:
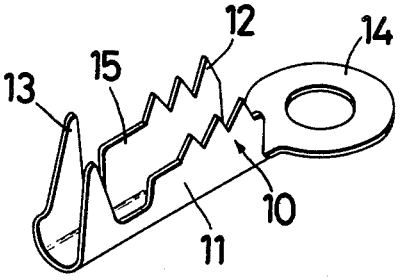
FIG. 6 is a schematic view of the third embodiment.

The third embodiment shown in FIG. 6 is similar to the first embodiment, but is provided with a flat portion 15 on the upper edge of each side wall 11 at its rear end next to the insulation barrel 13. The flat portion 15 is somewhat pressed into the conductor, but stress is distributed as it is not pointed.

In the embodiment of FIG. 6, too, the creeping distance d between the edge of the flat portion 15 on one side wall and that of the flat portion on the other side wall is sufficiently long to fully enclose the outer periphery of the conductor when the connector has been crimped.

The third embodiment can maintain good electrical connection at the front of the wire barrel while the provision of a flat portion at its rear lessens the possibility of weakening the conductor due to the penetration of the prongs into the conductor. The flat portion also offers resistance to the force tending to pull the conductor off the connector and prevents the conductor from getting damaged due to the bending force applied thereto.

Figure 7:
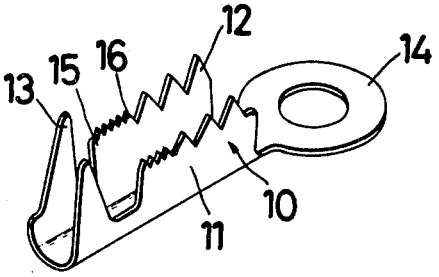
FIG. 7 is a schematic view of the fourth embodiment.

The fourth embodiment shown in FIG. 7 has flat portions 15 formed with small prongs 16 on their upper edge. These small prongs compensate for the reduction in the engagement with the conductor resulting from the provision of the flat portion 15. They also facilitate the penetration of the flat portion into the conductor because of their pointed top.

Figure 8:
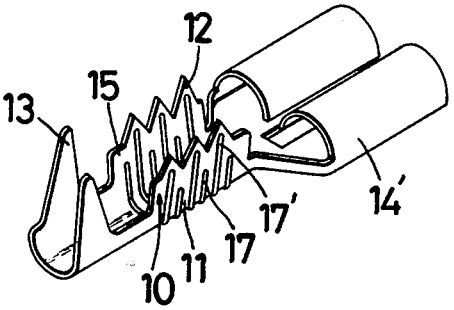
FIG. 8 is a schematic view of the fifth embodiment.
Figure 9:
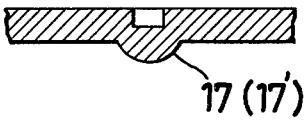
FIG. 9 is a sectional view of the bead provided on the embodiment of FIG. 8.

Referring to FIG. 8 showing the fifth embodiment, the wire barrel 10 is formed with a plurality of beads 17, 17' extending transversely or substantially perpendicular to the axis of the connector. In this embodiment, two groups of beads, one (17) being relatively shorter and the other (17') being longer and extending as far as to near the tip of the prongs 12, are combined. However, only either short or long beads may be used. The beads may also reach the tip of the prongs. As shown in FIG. 9, the beads 17 (17') are convex at the outer surface of the wire barrel 10 and are concave at its inner surface.

The embodiment of FIG. 8 is provided with an electrical connection portion 14' different from that in the former embodiments. This portion may be of any suitable shape.

The beads 17 (17') serve to hold the conductor more securely because the conductor gets stuffed in the recess of the beads. They also serve to reinforce the wire barrel 10 and resist the force pulling the conductor off the connector. Thirdly, contact between the conductor and the edge of the recess of the beads tends to decrease the electrical resistance of the conductor.

Although the present invention has been described with reference to the preferred embodiments, it is to be understood that various changes or modifications may be made within the scope of the present invention.

We claim:

1. An insulation piercing connector comprising a wire barrel and an electrical connection portion integral with said wire barrel, said wire barrel having an opposed pair of side walls, each of said side walls having a plurality of insulation piercing prongs formed on the edge thereof, said prongs being so shaped as to pierce into the conductor to be connected through its insulation when the connector is crimped around the conductor, said prongs having their pointed top which is higher at the end of said wire barrel adjacent to said electrical connection portion than at the opposite end thereof.

2. An insulation piercing connector as claimed in claim 1 wherein said prongs formed on one side wall are displaced with respect to the prongs on the other side wall so that they will bite each other when the connector is crimped.

3. An insulation piercing connector as claimed in claim 1 wherein said prongs on each side wall are of different sizes and larger at the end of said wire barrel adjacent to said electrical connection portion than at the opposite end thereof.

4. An insulation piercing connector as claimed in claim 1 wherein said prongs on each side wall are of the same size, said wire barrel being of a varying height increasing toward its end adjacent to the electrical connection portion.

5. An insulation piercing connector as claimed in claim 1 wherein the creeping distance between the baseline of said prongs on one side wall and that of the prongs on the other side wall is sufficient to fully enclose the outer periphery of the conductor to be connected.

6. An insulation piercing connector as claimed in claim 1 wherein each of said side walls is provided with a flat portion at the side thereof adjacent to said electrical connection portion and/or at the opposite side thereof.

7. An insulation piercing connector as claimed in claim 6 wherein the creeping distance between the edge of the flat portion on one side wall and that of the flat portion on the other side wall is sufficient to fully enclose the outer periphery of the conductor to be connected.

8. An insulation piercing connector as claimed in claim 6 or 7 wherein said flat portion is formed with small prongs at top edge thereof.

9. An insulation piercing connector as claimed in claim 1 wherein said wire barrel is formed with a plurality of beads extending in a transverse direction.

10. An insulation piercing connector as claimed in claim 9 wherein at least one of said beads extends up to the tip of a prong.

11. An insulation piercing connector as claimed in any of claims 1–10 further comprising an integral insulation barrel of a substantially U-shape at one end of the connector opposite to said electrical connection portion.

* * * * *